US009887442B2

(12) United States Patent
Lim et al.

(10) Patent No.: US 9,887,442 B2
(45) Date of Patent: Feb. 6, 2018

(54) RF FILTER FOR ADJUSTING COUPLING AMOUNT OR TRANSMISSION ZERO

(71) Applicant: ACE TECHNOLOGIES CORPORATION, Incehon-si (KR)

(72) Inventors: Dong-Yeon Lim, Incheon (KR); Guy-Yoil Yi, Incheon (KR); Kyung-Min Ko, Incheon (KR); Bong-Hoon Kim, Incheon (KR)

(73) Assignee: ACE TECHNOLOGIES CORPORATION, Incheon-si (KR)

( * ) Notice: Subject to any disclaimer, the term of this patent is extended or adjusted under 35 U.S.C. 154(b) by 50 days.

(21) Appl. No.: 14/709,354

(22) Filed: May 11, 2015

(65) Prior Publication Data

US 2015/0244050 A1 Aug. 27, 2015

Related U.S. Application Data

(62) Division of application No. 13/434,679, filed on Mar. 29, 2012, now abandoned.

(30) Foreign Application Priority Data

Mar. 31, 2011 (KR) ..... 10-2011-0029866
Mar. 31, 2011 (KR) ..... 10-2011-0029883

(51) Int. Cl.
*H01P 1/208* (2006.01)
*H01P 1/205* (2006.01)

(52) U.S. Cl.
CPC ..... *H01P 1/208* (2013.01); *H01P 1/2053* (2013.01); *H01P 1/2084* (2013.01)

(58) Field of Classification Search
CPC ..... H01P 1/201; H01P 1/205; H01P 1/208; H01P 1/2053; H01P 1/2084
USPC ..... 333/202, 203, 207, 208–209, 212, 219, 333/227, 231–233
See application file for complete search history.

(56) References Cited

U.S. PATENT DOCUMENTS 6,255,917 B1 * 7/2001 Scott ..... H01P 1/2053 29/527.2
6,559,740 B1 * 5/2003 Schulz ..... H01P 1/208 333/202
2009/0058563 A1 * 3/2009 Seo ..... H01P 7/04 333/209
2011/0133862 A1 * 6/2011 Chun ..... H01P 1/2084 333/209

* cited by examiner

*Primary Examiner* — Benny Lee
*Assistant Examiner* — Hafizur Rahman
(74) *Attorney, Agent, or Firm* — TechLaw LLP

(57) ABSTRACT

An RF filter, e.g. RF cavity filter for adjusting coupling amount or transmission zero is disclosed. The RF filter includes a housing member in which cavities are defined by walls, resonators located in the cavities, a cover combined with an upper surface of the housing member, a first tuning element inserted into a first cavity of the cavities through the cover, and a second tuning element inserted into a second cavity of the cavities through the cover. Here, the first tuning element and the second tuning element are connected electrically.

5 Claims, 14 Drawing Sheets

(A)

(B)

(A)

(B)

RF FILTER FOR ADJUSTING COUPLING AMOUNT OR TRANSMISSION ZERO

CROSS-REFERENCE TO RELATED APPLICATION

This application is a divisional of U.S. application Ser. No. 13/434,679, filed Mar. 29, 2012, all of which are hereby expressly incorporated by reference in its entirety for all purposes.

TECHNICAL FIELD

Example embodiment of the present invention relates to an RF filter, e.g. RF cavity filter for adjusting cross-coupling amount or transmission zero.

BACKGROUND ART

An RF cavity filter includes plural cavities formed therein to pass only use frequency band of a signal, and is employed generally at a base station, etc. using comparative high power of a frequency signal.

FIG. 1 is a plan view illustration structure of a common RF cavity filter.

In FIG. 1, the RF cavity filter includes an input connector 100, an output connector 102, a housing member 104, cavities 110, 112, 114, 116, 118 and 120 defined by the housing member 104 and a wall, resonators 130, 132, 134, 136, 138 and 140 in each of the cavities 110, 112, 114, 116, 118 and 120, and a coupling bar 160.

An RF signal inputted through the input connector 100 is provided to the cavity 110. Each of the cavities 110, 112, 114, 116, 118 and 120 and corresponding resonators 130, 132, 134, 136, 138 and 140 function as LC resonance elements, respectively.

The RF signal is delivered from one cavity to another cavity through a coupling window 150.

A resonance frequency of the filter is determined by size of the cavities and size of the resonators. A user may tune finely characteristics of the filter using tuning bolts which are not shown.

The skirt characteristic which means a slope of a boundary band in a pass band characteristic curve is important in view of the filter, and preferably should be formed sharply.

The skirt characteristic is improved according as order of the filter increases, i.e. the number of the cavities and the resonators increases. However, the skirt characteristic has trade-off relation with an insertion loss. That is, as the number of the cavities and the resonators increases, the skirt characteristic is enhanced but the insertion loss augments.

The filter forms a notch using cross coupling to improve the skirt characteristic with maintaining constant insertion loss.

The cross coupling means coupling between resonators which are not adjacent, e.g. coupling between a second resonator 132 and a fifth resonator 138. The cross coupling is realized generally through the coupling bar 160.

The coupling bar 160 is formed through a wall between the second cavity 122 and the fifth cavity 128, and is made up of a metal. The coupling bar 160 functions to deliver for example a signal of the second resonator 132 to the fifth resonator 138.

A hole for the coupling bar 160 is formed on the wall between the second cavity 122 and the fifth cavity 128, a dielectric layer is formed on an inner surface of the wall corresponding to the hole, and so the coupling bar 160 is not connected electrically to the wall.

However, this cross coupling structure may not adjust coupling amount between resonators. The coupling amount is determined by size of the coupling bar 160, and thus the coupling bar 160 should be replaced by new coupling bar having different size in case that desired coupling amount is not realized. In addition, the coupling amount may not be adjusted under the condition that the coupling bar 160 is set on the wall.

Moreover, the filter may not adjust transmission zero related to the skirt characteristic.

DISCLOSURE

Technical Problem

Example embodiment of the present invention provides an RF filter, for example RF cavity filter for adjusting cross coupling amount or transmission zero.

Technical Solution

An RF filter according to one embodiment of the present invention includes a housing member in which cavities are defined by walls; resonators located in the cavities; a cover combined with an upper surface of the housing member; a first tuning element inserted into a first cavity of the cavities through the cover; and a second tuning element inserted into a second cavity of the cavities through the cover. Here, the first tuning element and the second tuning element are connected electrically.

An RF filter according to another embodiment of the present invention includes a housing member; a cover combined with an upper surface of the housing member; a first tuning area formed on one surface of the cover; a second tuning area formed on the one surface of the cover with separated from the first tuning area; a dielectric area formed between the first tuning area and the second tuning area on the one surface of the cover; and a third tuning element disposed on the dielectric area. Here, the first tuning area and the second tuning area are conductive areas.

An RF filter according to still another embodiment of the present invention includes a housing member; a cover combined with an upper surface of the housing member; a first tuning area formed on one surface of the cover; a second tuning area formed on the one surface of the cover with separated from the first tuning area; a dielectric area formed between the first tuning area and the second tuning area on the one surface of the cover; a first tuning element inserted into the housing member through the first tuning area of the cover; a second tuning element inserted into the housing member through the second tuning element of the cover; and a tuning sliding member disposed on the one surface of the cover. Here, a part of the tuning sliding member overlaps with the dielectric area.

Advantageous Effects

An RF filter according to the present invention controls tuning elements inserted in corresponding cavities through a cover, thereby adjusting cross coupling amount or transmission zero. Specially, variable range of coupling coefficient and transmission zero may be considerably wide.

The RF filter according to the present invention adjusts capacitance between the tuning elements using a lumped element or a tuning sliding member under the condition that the tuning elements are inserted into corresponding cavities through the cover, and so cross coupling amount between corresponding resonators or transmission zero may be adjusted. Specially, a user may control the lumped element and the tuning sliding member outside to tune easily characteristics of the filter.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
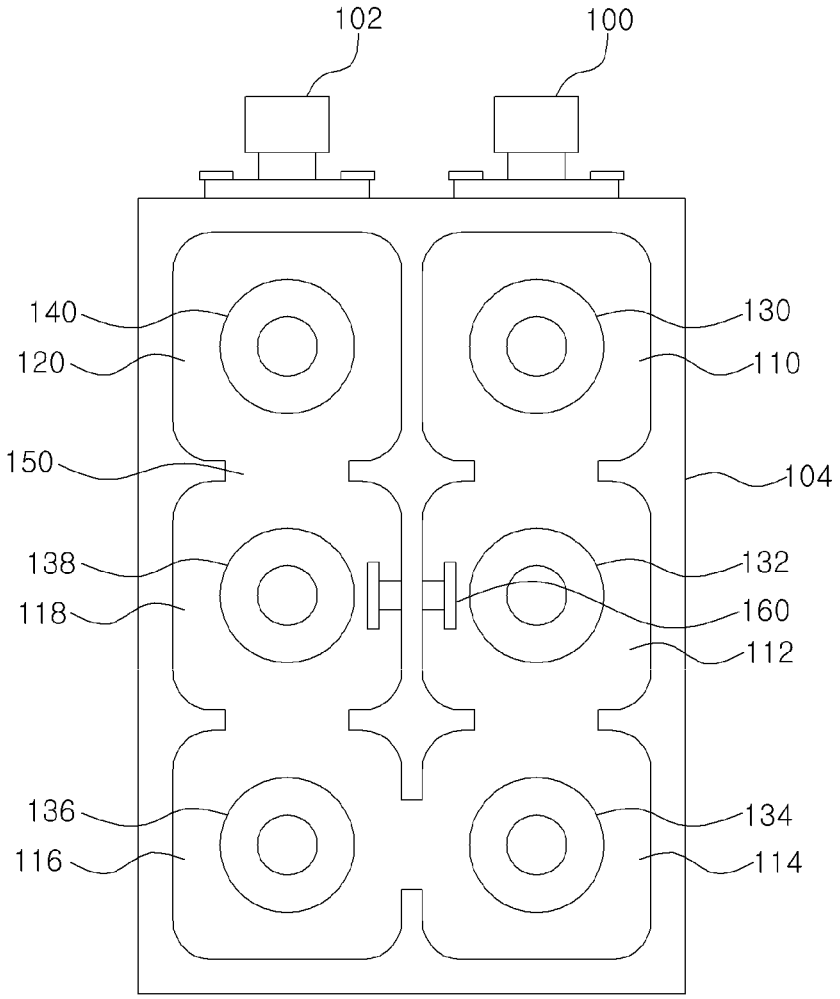
FIG. 1(Prior Art)
FIG. 1 is a plan view illustration structure of a common RF cavity filter.
Figure 2:
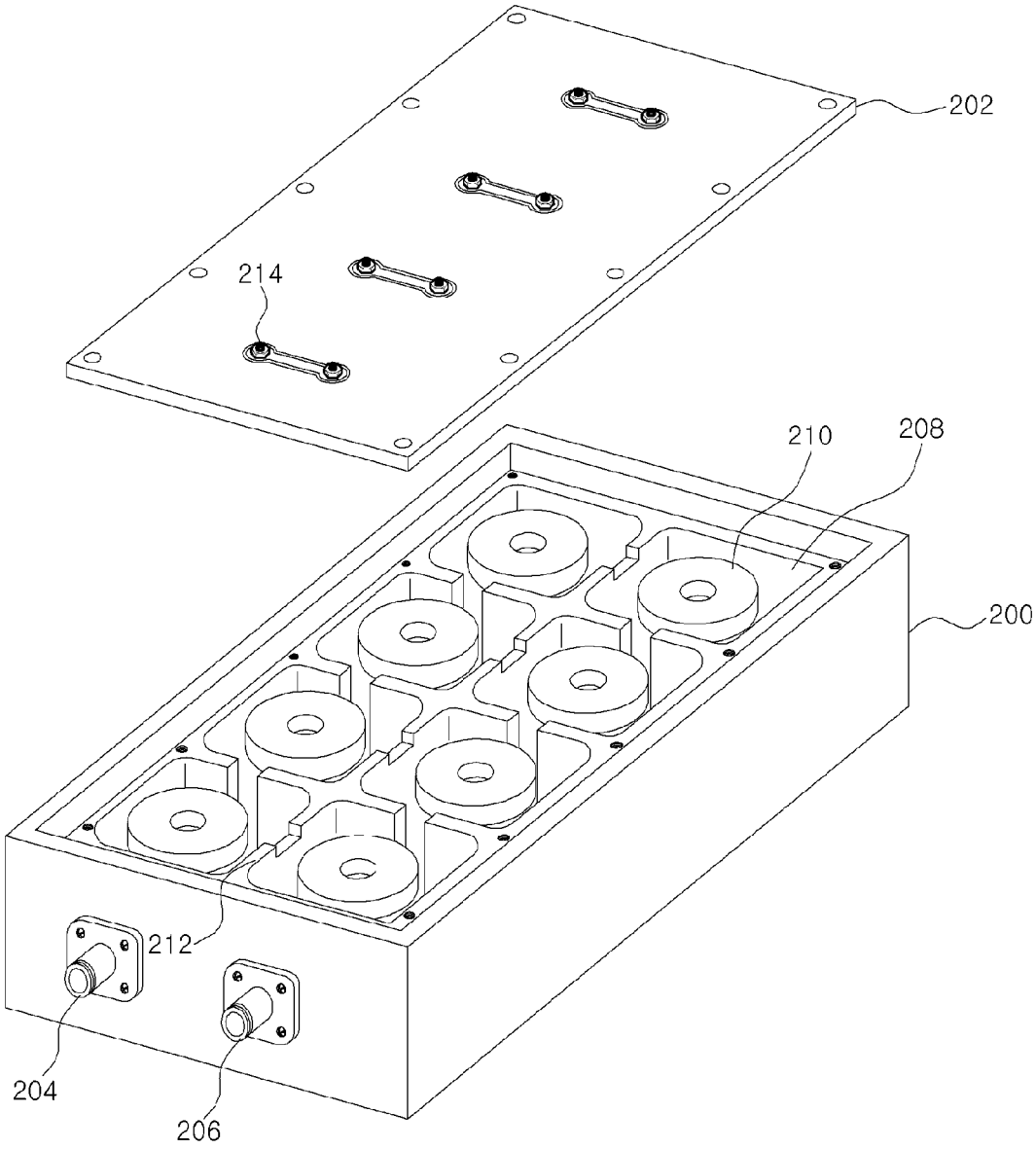
FIG. 2 is a perspective view illustrating an RF filter according to a first embodiment of the present invention.

FIG. 2 is a perspective view illustrating an RF filter according to a first embodiment of the present invention.

In FIG. 2, the RF filter of the present invention is for example an RF cavity filter, and includes a housing member 200, a cover 202, an input connector 204, an output connector 206, cavities 208, resonators 210, walls 212 and tuning elements 214.

The housing member 200 protects elements in the RF filter, and blocks an electromagnetic wave. The housing member 200 may be formed by coating silver having high conductivity on an aluminum material.

The cover 202 is combined with an upper surface of the housing member 200, for example may be combined with the upper surface of the housing member 200 through a bolt, etc. The cover 202 may be formed by for example coating silver on aluminum material, and functions as a ground.

An RF signal is inputted through the input connector 204 and is outputted through the output connector 206. Here, the RF signal propagates through coupling windows formed in each of the cavities 208. Resonance of the RF signal is generated by the cavities 208 and the resonators 210, and the RF signal is filtered by the resonance.

The cavities 208 are defined by the walls 212, and each of the resonators 210 is formed in corresponding cavity 208. As the number of the resonator 210 and the cavity 208 increases, the skirt characteristic of the RF filter is enhanced but the insertion loss is deteriorated. Accordingly, the number of the resonator 210 and the cavity 208 are determined according to desired skirt characteristic and the insertion loss.

The resonator 210 may be a cylindrical resonator as shown in FIG. 2, but various resonators such as a disk type resonator, etc. may be employed as the resonator 210. The resonator 210 may be made up of a metal or dielectric member according to mode of the RF filter, i.e. TE mode or TM mode.

The tuning elements 214 are made up of for example a metal, are used to adjust cross coupling amount or transmission zero, and are inserted in corresponding cavity 208 under the condition that it combines with the cover 202. It is desirable that two tuning elements 214 face on the basis of the wall 212, i.e. a first tuning element is inserted in the cavity 208 located in the left of the wall 212 as shown in FIG. 2 and a second tuning element 214 is inserted in the cavity 208 located in the right of the wall 212.

In one embodiment of the present invention, the tuning elements 214 are tuning bolts, and are connected electrically each other under the condition that they combine with the cover 202. However, the tuning elements 214 are not connected electrically to the cover 202.

A user may adjust cross coupling amount or transmission zero by moving up and down the tuning element 214.

Hereinafter, a process of adjusting coupling amount or transmission zero using the tuning elements 214 and disposition of the tuning elements 214 will be described in detail with reference to accompanying drawings.

Figure 3:
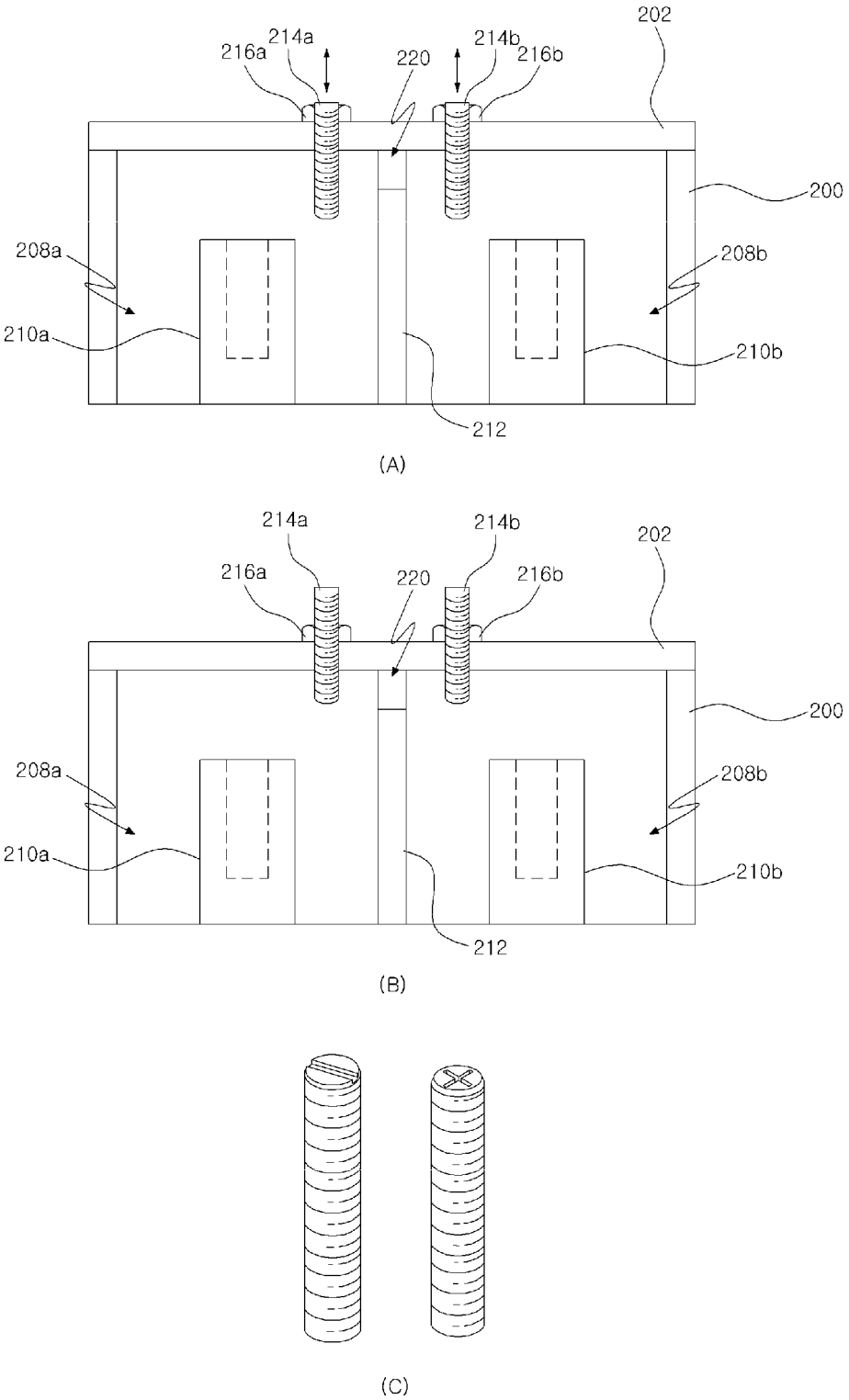
FIG. 3(A) and FIG. 3(B) are views illustrating schematically a part of the RF filter according to one embodiment of the present invention and FIG. 3(C) is a view illustrating a rotation tool according to one embodiment of the present invention.
Figure 4:
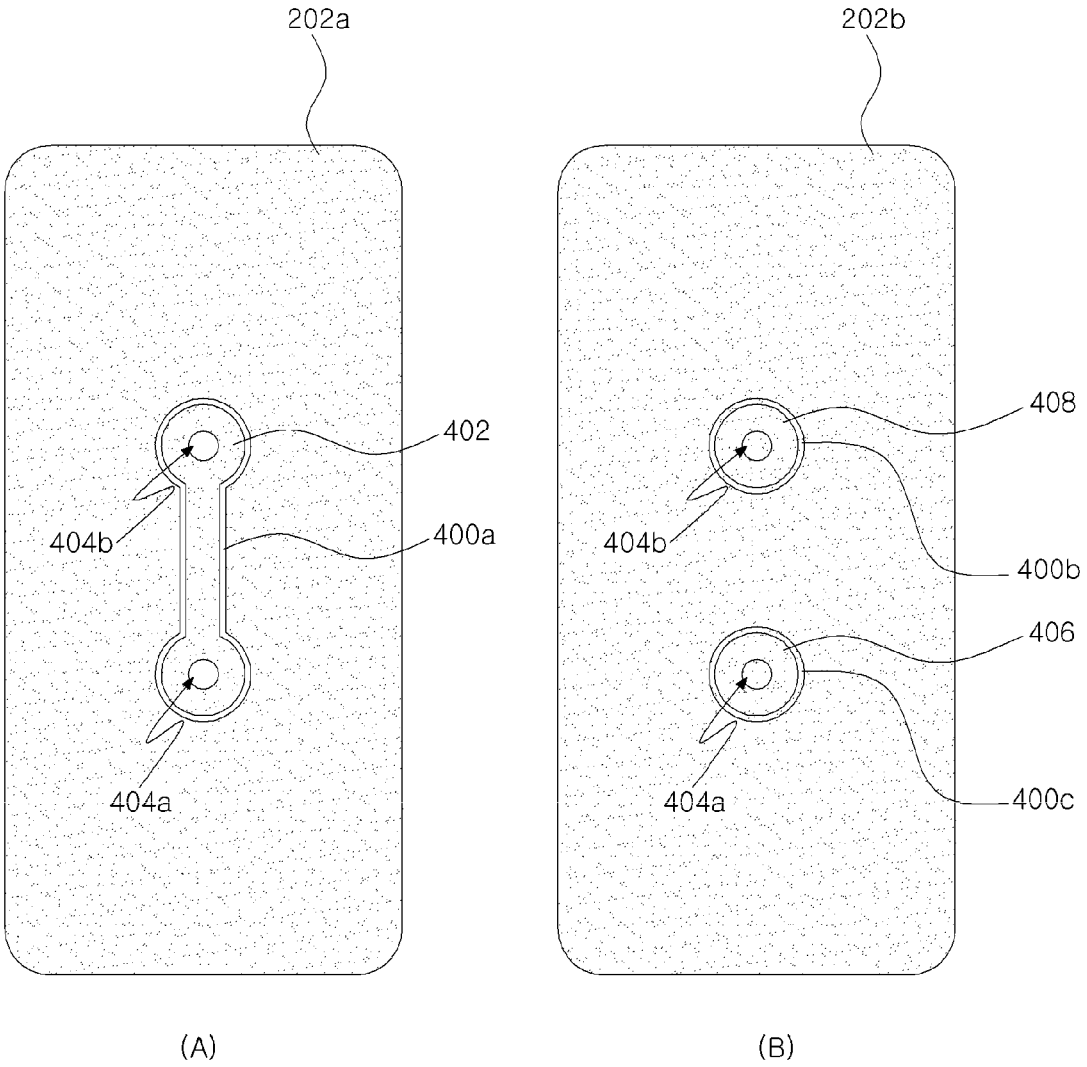
FIG. 4(A) and FIG. 4(B) are views illustrating structure of a cover and connection structure of tuning elements according to one embodiment of the present invention.
Figure 5:
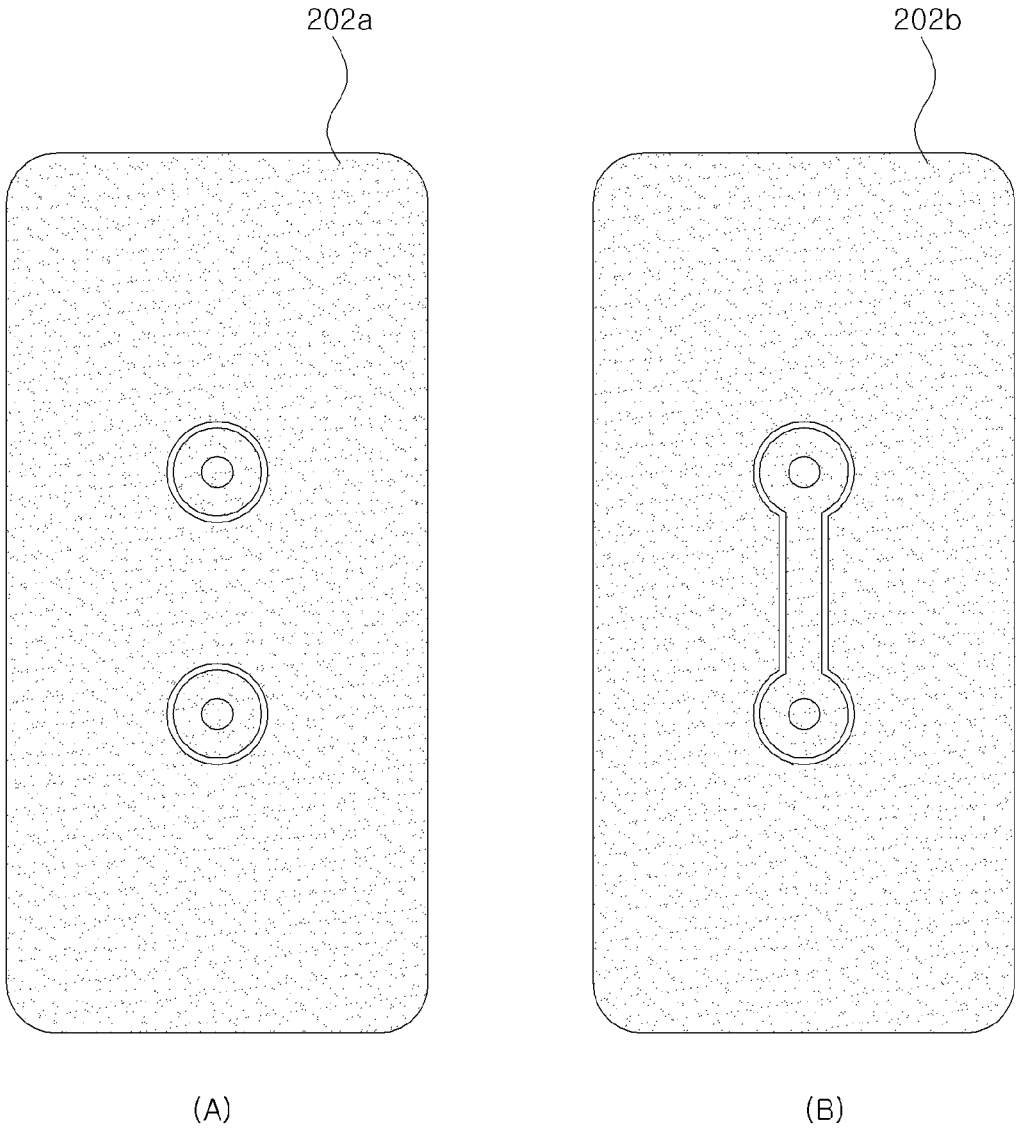
FIG. 5(A) and FIG. 5(B) are views illustrating structure of a cover and connection structure of tuning elements according to another embodiment of the present invention.
Figure 6:
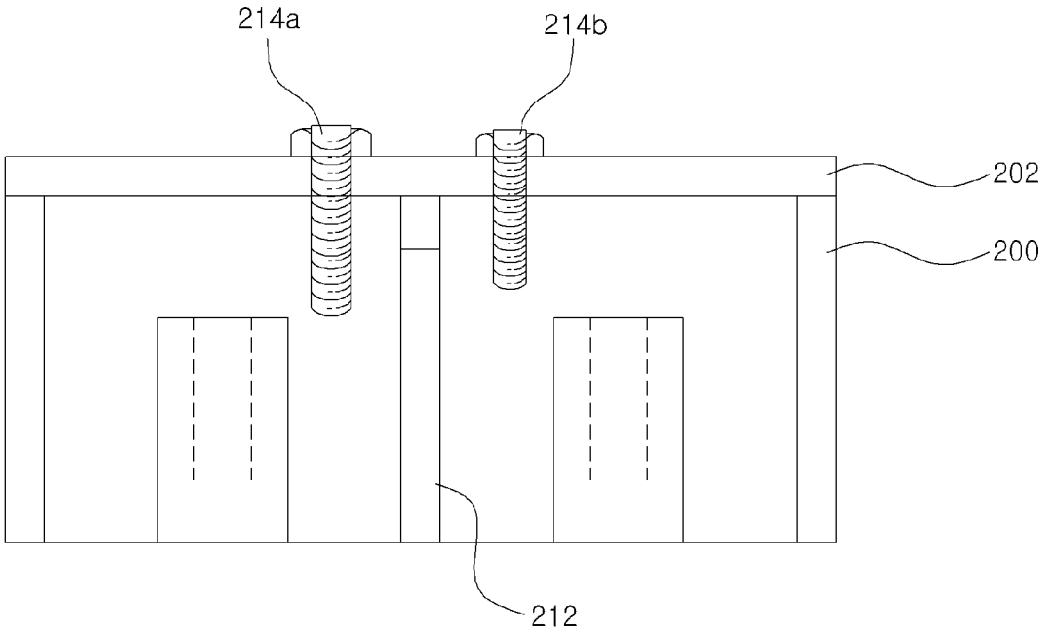
FIG. 6(A) and FIG. 6(B) are sectional views illustrating various tuning elements according to one embodiment of the present invention.
Figure 6:
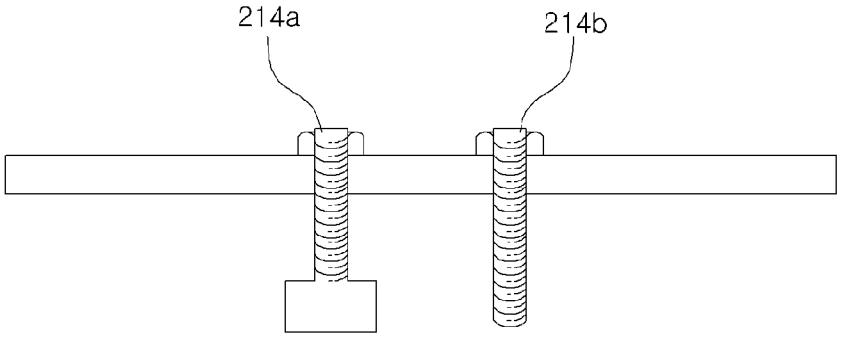

FIG. 3 is a view illustrating schematically a part of the RF filter according to one embodiment of the present invention, and FIG. 4 is a view illustrating structure of a cover and connection structure of tuning elements according to one embodiment of the present invention. FIG. 5 is a view illustrating structure of a cover and connection structure of tuning elements according to another embodiment of the present invention, and FIG. 6 is a sectional view illustrating various tuning elements according to one embodiment of the present invention.

In FIG. 3(A), a first resonator 210*a* is disposed in a first cavity 208*a*, a second resonator 210*b* is located in a second cavity 208*b*, and the wall 212 is disposed between the cavities 208*a* and 208*b*.

A first tuning element 214*a* is inserted into the first cavity 208*a* through the cover 202, and combines with the cover 202 through a first nut 216*a*. A screw thread is formed on the first tuning element 214*a*, and so the first tuning element 214*a* moves up and down with combined with the cover 202 as shown in FIG. 3(B) in case that the first tuning element 214*a* rotates. It is desirable that a groove in which a rotation tool such as a driver, etc. is inserted is formed on an upper surface of the first tuning element 214*a* as shown in FIG. 3(C). The user may move the first tuning element 214*a* up and down by rotating the first tuning element 214*a* after the user inserts the rotation tool into the groove. As a result, insertion depth of the first tuning element 214*a* to the first cavity 208*a* is changed, and thus cross coupling amount or transmission zero may be adjusted.

A second tuning element 214*b* is inserted into a second cavity 208*b* through the cover 202, faces to the first tuning element 214*a* on the basis of the wall 212, and combines with the cover 202 through a second nut 216*b*. A screw thread is formed on the second tuning element 214*b*, and so the second tuning element 214*b* moves up and down with combined with the cover 202 as shown in FIG. 3(B) in case that the second tuning element 214*b* rotates. As a result, cross coupling amount or transmission zero is adjusted.

The tuning elements 214*a* and 214*b* are connected electrically. In one embodiment of the present invention, a first tuning area 402 and holes 404*a* and 404*b* may be formed on an upper surface 202*a* of the cover 202 as shown in FIG. 4(A), and a second tuning area 406, a third tuning area 408 and the holes 404*a* and 404*b* may be formed on a rear surface of the cover 202 as shown in FIG. 4(B). The first tuning element 214*a* is inserted into the first cavity 208*a* through the first hole 404*a*, and the second tuning element 214*b* is inserted into the second cavity 208*b* through the second hole 404*b*. Here, the tuning areas 402, 406 and 408 are conductive areas, and thus the tuning elements 214*a* and 214*b* are connected electrically through the first tuning area 402 formed on the upper surface 202*a* of the cover 202.

In case of etching the upper surface and the rear surface of the cover 202 formed by coating conductive material on a dielectric member according to the tuning areas 402, 406 and 408, the etching areas 400*a*, 400*b* and 400*c* are formed. No conductive material exists in the etching areas 400*a*, 400*b* and 400*c*. As a result, the tuning areas 402, 406 and 408 are separated electrically from the conductive material of the cover 202 by the etching areas 400*a*, 400*b* and 400*c*. Accordingly, the tuning elements 214*a* and 214*b* are connected electrically through the first tuning area 402, but are not connected electrically to the coating material of the cover 202, i.e. are not connected to the ground.

In another embodiment of the present invention, a second tuning area, a third tuning area and holes may be formed on the upper surface 202*a* of the cover 202 as shown in FIG. 5(A), and a first tuning area and the holes may be formed on the rear surface 202*b* of the cover 202 as shown in FIG. 5(B). The tuning elements 214*a* and 214*b* are connected electrically through the first tuning area formed on the rear surface 202*b* of the cover 202.

In still another embodiment of the present invention, a tuning area and holes may be formed on the upper surface 202*a* of the cover 202 as shown in FIG. 4(A), and a tuning area and holes may be formed on the rear surface 202*b* of the cover 202 as shown in FIG. 5(B). The tuning elements 214*a* and 214*b* are connected electrically by the tuning areas.

In still another embodiment of the present invention, a groove 220 is formed on an upper surface of the wall 212 to prevent electrical connection of the conductive material in the tuning area formed on the rear surface 202*b* of the cover 202 and the wall 212.

The user may adjust the cross coupling amount or the transmission zero in the above RF filter by changing the insertion depths of the tuning elements 214*a* and 214*b* to the cavities 208*a* and 208*b*. Here, insertion depths of the tuning elements 214*a* and 214*b* are the same or different. In addition, tuning of the tuning elements 214*a* and 214*b* when the coupling amount is adjusted may be different from that of the tuning elements 214*a* and 214*b* when the transmission zero is adjusted.

On the other hand, length, thickness and shape, etc. of the tuning elements 21*a* and 214*b* may be different. For example, the first tuning element 214*a* may have greater thickness than the second tuning element 214*b* as shown in FIG. 6(A), or the first tuning element 214*a* may have different shape and thickness compared with the second tuning element 214*b*. That is, the tuning elements 214*a* and 214*b* may be variously modified as long as the cross coupling amount or the transmission zero is adjusted.

Hereinafter, experimental result of coupling characteristics of the RF filter according to the present invention will be described in detail.

Figure 7:
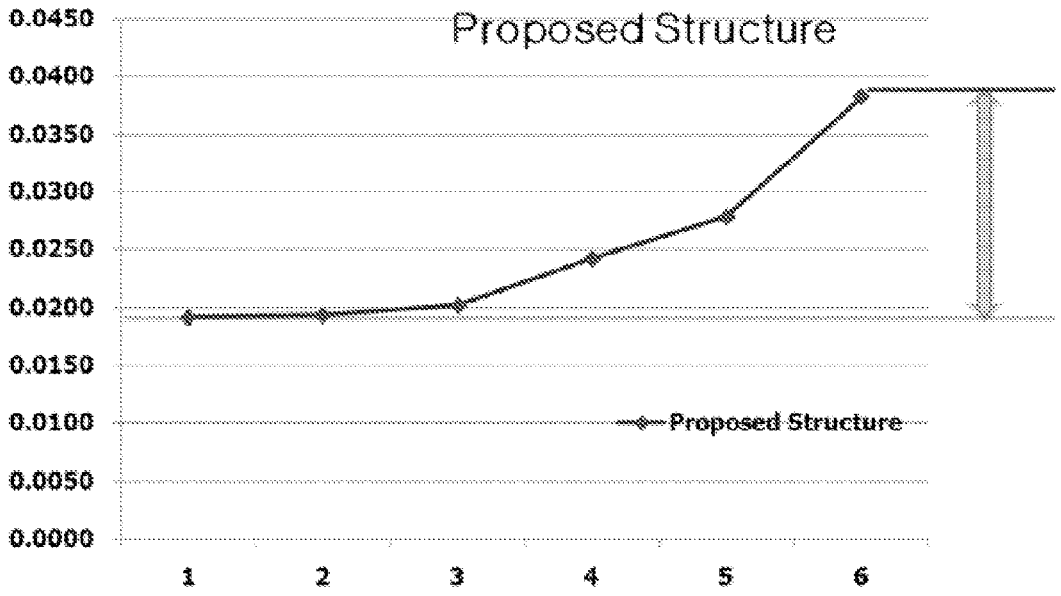
FIG. 7 is a view illustrating experimental result of coupling coefficient of the RF filter according to one embodiment of the present invention.
Figure 8:
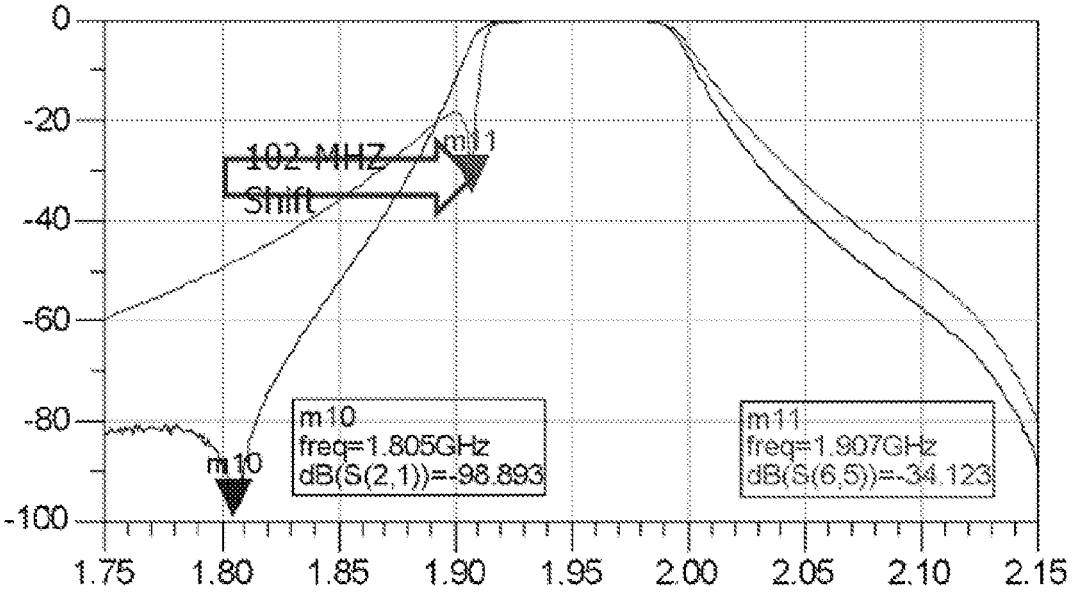
FIG. 8 is a view illustrating experimental result of transmission zero of the RF filter according to one embodiment of the present invention.

FIG. 7 is a view illustrating experimental result of coupling coefficient of the RF filter according to one embodiment of the present invention, and FIG. 8 is a view illustrating experimental result of transmission zero of the RF filter according to one embodiment of the present invention.

Referring to FIG. 7, it is verified that the coupling coefficient between the resonators 210 is changed by 0.019 (changed from 0.0191 to 0.0382). Coupling coefficient of the resonators in convention RF filter is changed by 0.0039. In other words, the RF filter of the present invention may be changed by approximately three times compared with the conventional RF filter. Accordingly, the RF filter of the present invention may tune the cross coupling amount between the resonators 210 in wide range.

In FIG. 8, it is verified that the transmission zero is changed from 1.805 GHz to 1.907 GHz. That is, the transmission zero is changed by 102 MHz. However, the transmission zero may be changed by above 102 MHz. Accordingly, the RF filter of the present invention may adjust skirt characteristic, etc. according to spec required for the RF filter.

Figure 9:
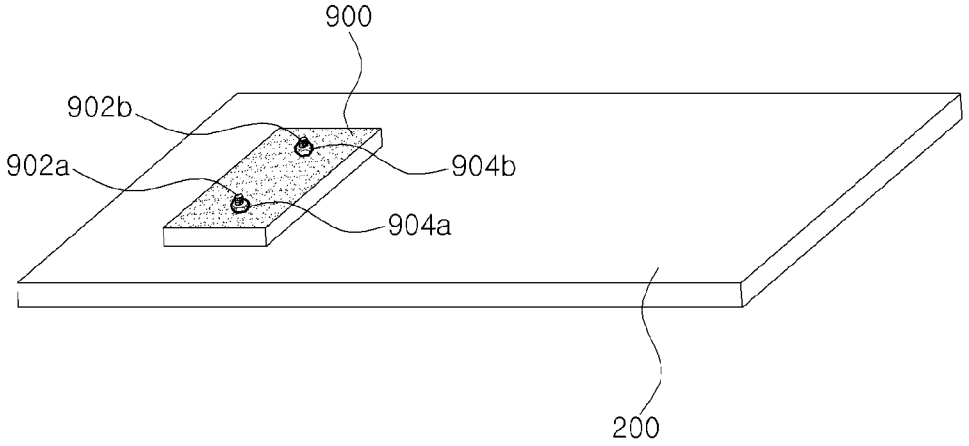
FIG. 9 is a view illustrating schematically structure of an RF filter according to a second embodiment of the present invention.

FIG. 9 is a view illustrating schematically structure of an RF filter according to a second embodiment of the present invention. FIG. 9 does not show a housing member, resonators, etc.

In FIG. 9, the RF filter of the present embodiment includes a cover 200, a supporting member 900, tuning elements 902*a* and 902*b* and nuts 904*a* and 904*b*.

The supporting member 900 is formed on an upper surface of the cover 200, and may be formed by coating conductive material on a dielectric member.

A first tuning element 902*a* is inserted into corresponding cavity through the supporting member 900 and the cover 200, and a second tuning element 902*b* is inserted into corresponding cavity through the supporting member 900 and the cover 200. Since an upper surface of the supporting member 900 is coated with conductive material, the tuning elements 902*a* and 902*b* are connected electrically. However, the tuning elements 902*a* and 902*b* are not connected electrically to the cover 202 because a base of the supporting member 900 is made up of dielectric member.

The tuning elements 902*a* and 902*b* are fixed to the supporting member 900 by the nuts 904*a* and 904*b*.

In brief, in the RF filter, the supporting member 900 is formed on the cover 200, and the tuning elements 902*a* and 902*b* are inserted into corresponding cavities through the supporting member 900 and the cover 200. Accordingly, unlike the RF filter in the first embodiment where the upper surface of the cover is etched, the upper surface of the cover may not be etched in the RF filter of the present embodiment.

Figure 10:
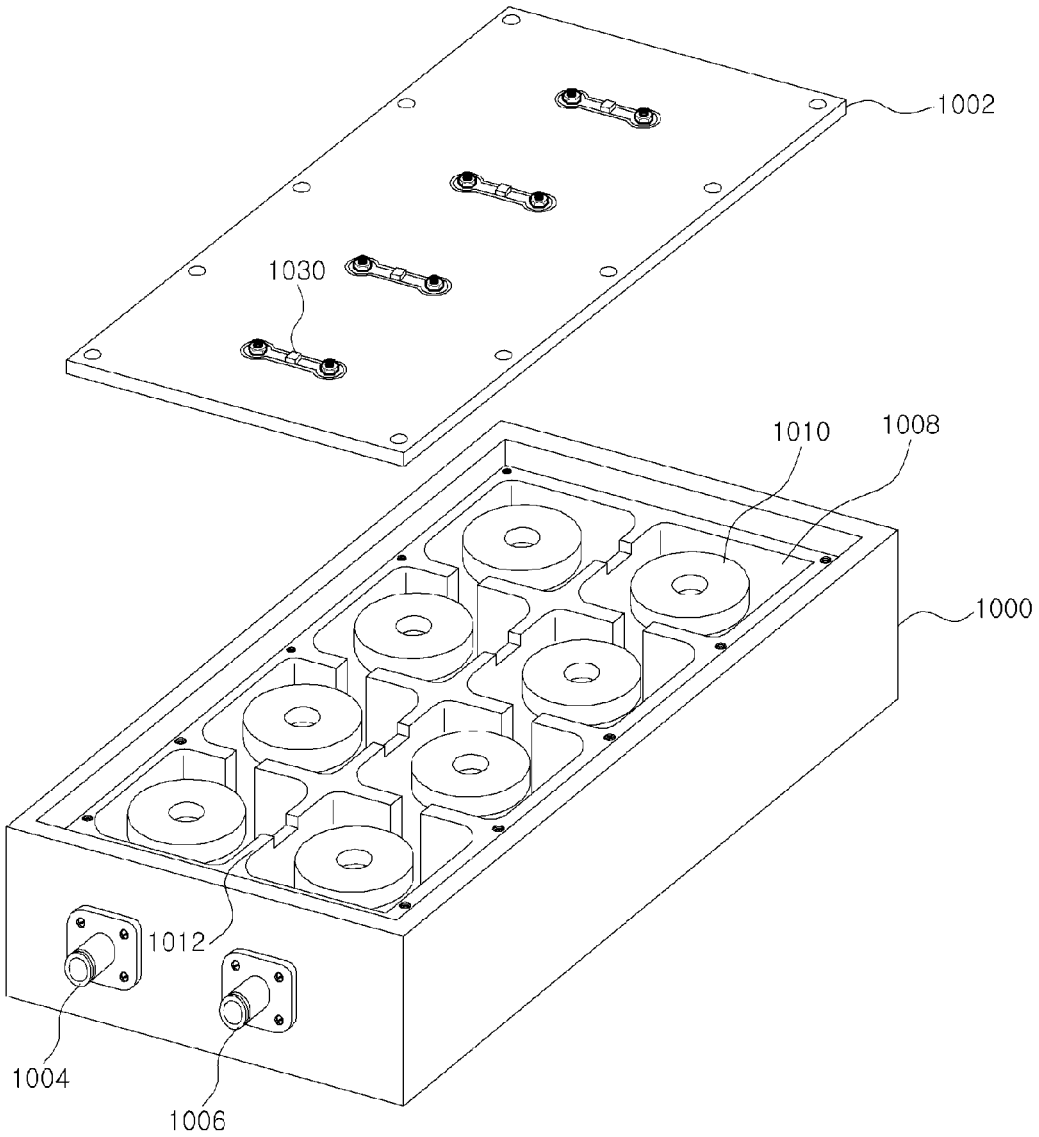
FIG. 10 is a perspective view illustrating an RF filter according to a third embodiment of the present invention.

FIG. 10 is a perspective view illustrating an RF filter according to a third embodiment of the present invention.

In FIG. 10, the RF filter of the present invention is for example an RF cavity filter, and includes a housing member 1000, a cover 1002, an input connector 1004, an output connector 1006, cavities 1008, resonators 1010, walls 1012 and a third tuning element 1030.

Since the housing member 1000, the cover 1002, the input connector 1004, the output connector 1006, the cavities 1008, the resonators 1010 and the walls 1012 are the same in FIG. 2, any further description concerning the same elements will be omitted.

The third tuning element 1030 is for example a metal, is used for adjusting cross coupling amount or transmission zero, and is disposed on an upper surface of the cover 1002.

In one embodiment of the present invention, the third tuning element 1030 may be a lumped element such as a capacitor, an inductor, etc.

Hereinafter, a process of adjusting coupling amount or transmission zero using the third tuning element 1030 and structure of the RF filter will be described in detail with reference to accompanying drawings.

Figure 11:
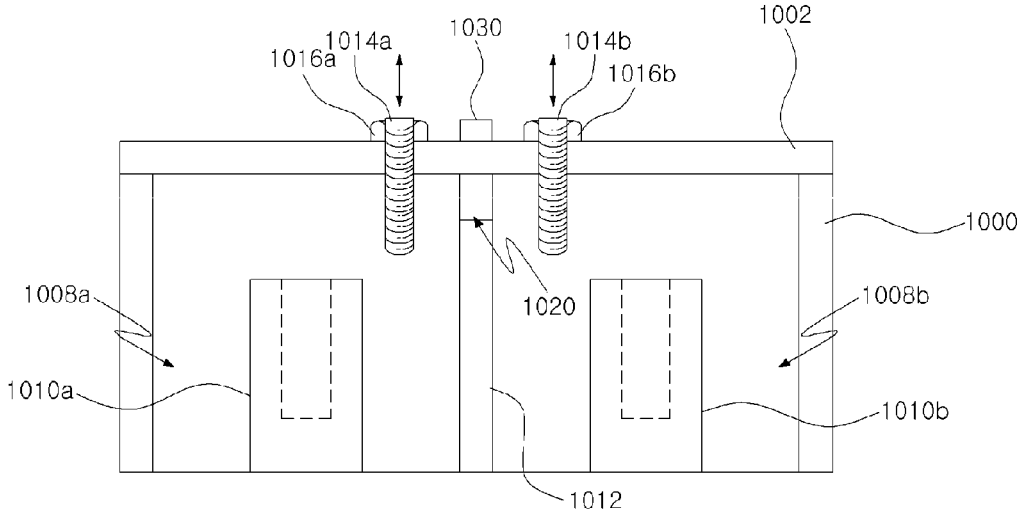
FIG. 11(A) and FIG. 11(B) are views illustrating structure of an RF filter according to a third embodiment of the present invention.
Figure 11:
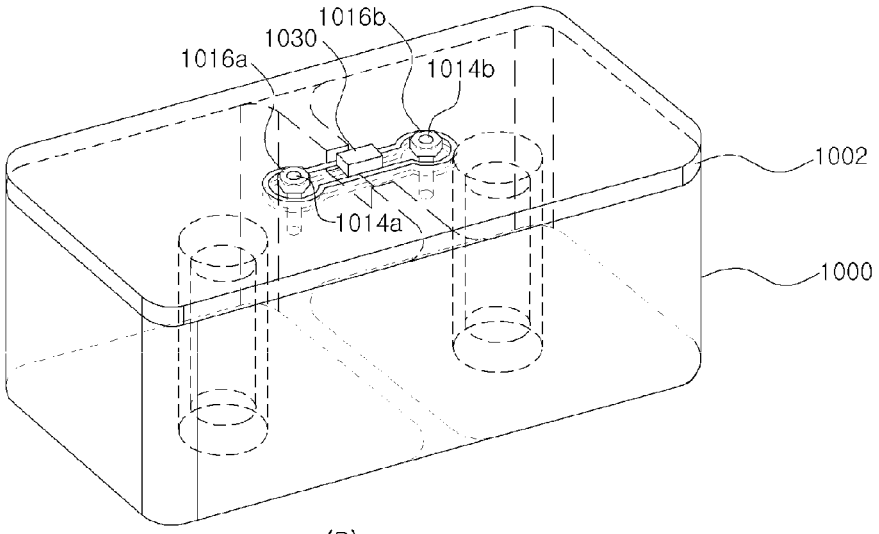
Figure 12:
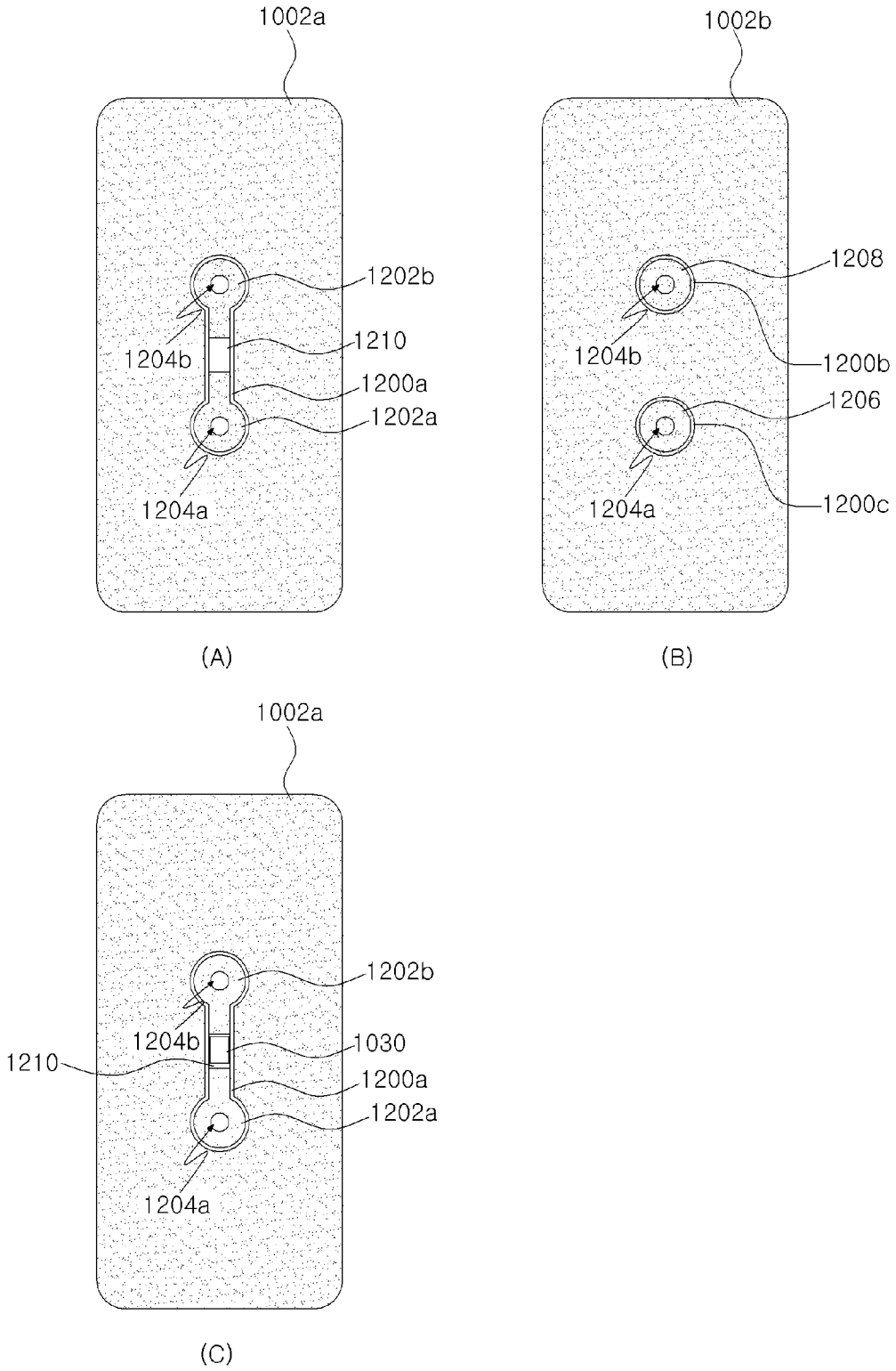
FIG. 12(A), FIG. 12(B), and FIG. 12(C) are top views illustrating a cover according to another embodiment of the present invention.

FIG. 11 is a view illustrating structure of an RF filter according to a third embodiment of the present invention, and FIG. 12 is a top view illustrating a cover according to another embodiment of the present invention.

In FIG. 12(A), an etching area 1200*a*, a first tuning area 1202*a*, a second tuning area 1202*b* and a dielectric area 1210 are formed on an upper surface 1002*a* of the cover 1002.

In FIG. 12(B), etching areas 1200*b* and 1200*c*, a third tuning area 1206 and a fourth tuning area 1208 are formed on a rear surface 1002*b* of the cover 1002.

The tuning areas 1202*a*, 1202*b*, 1206 and 1208 are conductive areas, for example are coated by conductive material.

A first hole 1204*a* is formed in the first tuning area 1202*a* and the third tuning area 1206, and a second hole 1204*b* is formed in the second tuning area 1202*b* and the fourth tuning area 1208. A first tuning element 1014*a* as for example a conductor is inserted into a first cavity 1008*a* through the first tuning area 1202*a* and the third tuning area 1206 of the cover 1002 as shown in FIG. 11. A second tuning element 1014*b* as for example a conductor is inserted into a second cavity 1008*b* through the second tuning area 1202*b* and the fourth tuning area 1208 of the cover 1002.

In one embodiment of the present invention, screw thread is formed on outer surfaces of the first tuning element 1014*a* and the second tuning element 1014*b*. Accordingly, the first tuning element 1014*a* or the second tuning element 1014*b* may move up and down with supported by the cover 1002 in case that the first tuning element 1014*a* or the second tuning element 1014*b* rotates.

The first tuning element 1014*a* is fixed to the upper surface 1002*a* of the cover 1002 by a first nut 1016*a*, and the second tuning element 1014*b* is fixed to the upper surface 1002*a* of the cover 1002 by a second nut 1016*b*.

The dielectric area 1210 locates between the first tuning area 1202*a* and the second tuning area 1202*b* in the first etching area 1200*a*. Here, the first tuning area 1200*a* and the second tuning area 1200*b* are separated physically, but coupling is generated between the first tuning area 1200*a* and the second tuning area 1200*b* by the dielectric area 1210. That is, certain capacitance is formed between the first tuning area 1202*a* and the second tuning area 1202*b*. Accordingly, the first tuning element 1014*a* and the second tuning element 1014*b* are connected electrically through a coupling method, and so cross coupling generates between the resonators 1010*a* and 1010*b* in the cavities 1008*a* and 1008*b* where the tuning elements 1014*a* and 1014*b* are inserted.

In one embodiment of the present invention, the third tuning element 1030 as a lumped element is disposed in the dielectric area 1210. As a result, the capacitance between the first tuning area 1202*a* and the second tuning area 1202*b* is changed by the third tuning element 1030, e.g. a capacitor, and thus cross coupling amount between the resonators 1010*a* and 1010*b* or transmission zero is changed. In other words, the cross coupling amount between the resonators 1010*a* and 1010*b* or the transmission zero may vary depending on the third tuning element 1030 disposed on the dielectric area 1210 as shown in FIG. 12(C). Accordingly, the user may select properly the third tuning element 1030 to realize desired cross coupling amount or transmission.

In one embodiment of the present invention, to adjust the cross coupling amount or the transmission zero, the user may change only the third tuning element 1030 under the condition that he fixes the first tuning element 1014*a* and the second tuning element 1014*b*, or change the first tuning element 1014*a* or the second tuning element 1014*b* as well as the third tuning element 1030. Here, the first tuning element 1014*a* or the second tuning element 1014*b* moves up and down.

In another embodiment of the present invention, a groove 1020 may be formed on an upper surface of the wall 1012 to prevent electrical connection of conductive material of the tuning area 1206 and 1208 formed on the rear surface 1002*b* of the cover 1002 and the wall 1012.

The dielectric area 1210 may be formed by removing coating material of the cover 1002, i.e. the dielectric member of the cover 1002 is exposed.

In short, the RF filter of the present embodiment may adjust the cross coupling amount or the transmission zero by using the third tuning element 1030.

Figure 13:
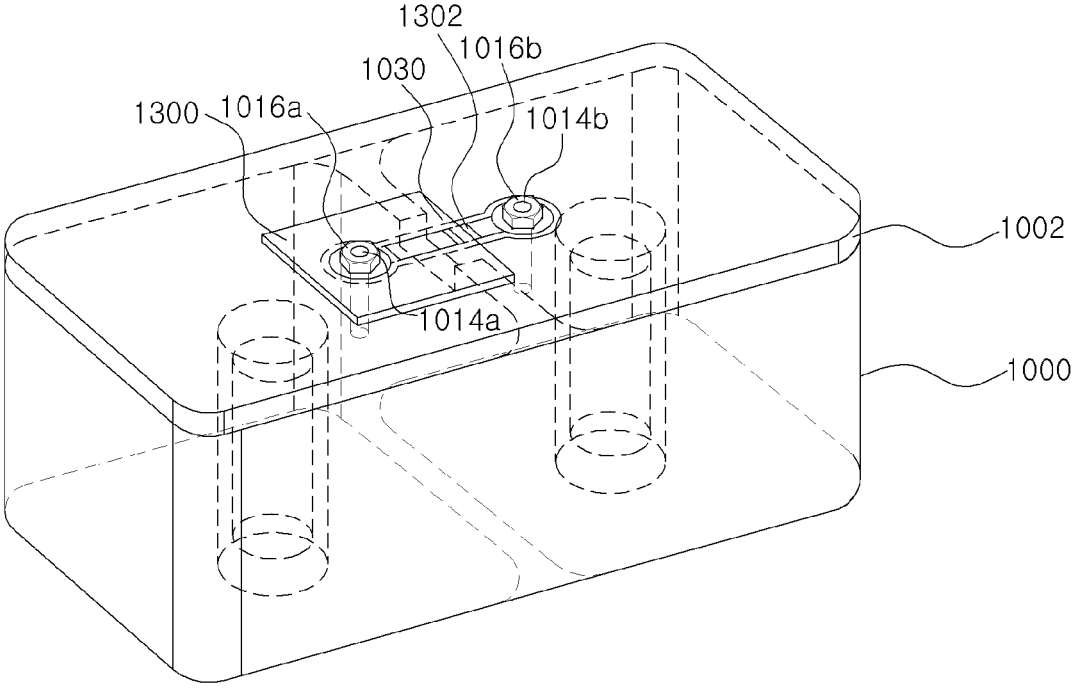
FIG. 13 is a perspective view illustrating an RF filter according to a fourth embodiment of the present invention.
Figure 14:
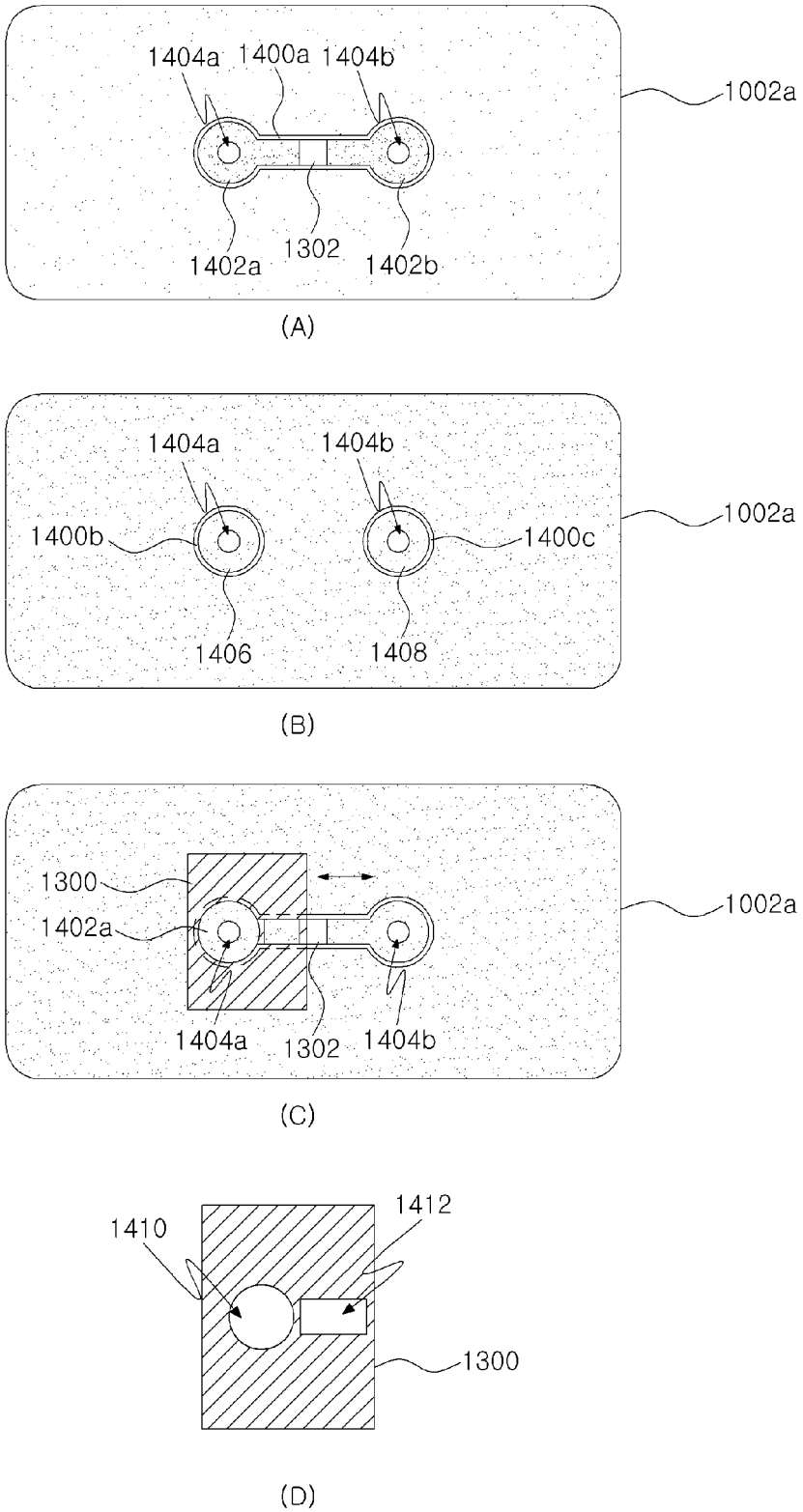
FIG. 14(A), FIG. 14(B), and FIG. 14(C) are top views illustrating a cover of the RF filter in FIG. 13 according to one embodiment of the present invention
FIG. 14(D) is a view illustrating a tuning sliding member of the RF filter in FIG. 13 according to one embodiment of the present invention.

FIG. 13 is a perspective view illustrating an RF filter according to a fourth embodiment of the present invention, and FIG. 14 is a top view illustrating a cover of the RF filter in FIG. 13 according to one embodiment of the present invention.

In FIG. 13, the RF filter of the present embodiment includes a housing member 1000, a cover 1002, a first tuning element 1014*a*, a second tuning element 1014*b*, a first nut 1016*a*, a second nut 1016*b* and a tuning sliding member 1300 as a dielectric member.

In FIG. 14, an etching area 1400*a*, a first tuning area 1402*a*, a second tuning area 1402*b* and a dielectric area 1302 are formed on an upper surface 1002*a* of the cover 1002.

In FIG. 14(B), etching areas 1400*b* and 1400*c*, a third tuning area 1406 and a fourth tuning area 1408 are formed on a rear surface 1002*b* of the cover 1002.

The tuning areas 1402*a*, 1402*b*, 1406 and 1408 are conductive areas, for example are coated with conductive material.

A first tuning element 1014*a* is inserted into a first cavity 1008*a* through the first tuning area 1402*a* and the third tuning area 1406 of the cover 1002, and a second tuning element 1014*b* is inserted into a second cavity 1008*b* through the second tuning area 1402*b* and the fourth tuning area 1408 of the cover 1002.

The first tuning element 1014*a* is fixed to the upper surface of the cover 1002 by the first nut 1016*a*, and the second tuning element 1014*b* is fixed to the upper surface 1002*a* of the cover 1002 by the second nut 1016*b*.

The dielectric area 1302 locates between the first tuning area 1402*a* and the second tuning area 1402*b* in the first etching area 1400*a*. The first tuning area 1400*a* and the second tuning area 1400*b* are separated physically, but coupling generates between the first tuning area 1400*a* and the second tuning area 1400*b*.

In one embodiment of the present invention, two holes 1410 and 1412 may be formed on the tuning sliding member 1300 as shown in FIG. 14(D). The tuning sliding member 1300 is fixed by the first tuning element 1014*a* inserted into the first cavity 1008*a* through the first hole 1410 and the cover 1002 or the first nut 1016*a*, and may shift left and right as shown in FIG. 14(C) under the condition that it is fixed by the first tuning element 1014*a* or the first nut 1016*a*. An end part of the tuning sliding member 1300 overlaps on the dielectric area 1302, and capacitance between the tuning elements 1402*a* and 1402*b* is varied according to the overlap area. As a result, cross coupling amount between corresponding resonators or transmission zero may be changed. The tuning sliding member 1300 may shift front and rear direction. The tuning sliding member 1300 may be fixed through various methods after it is shifted to desired position.

In brief, the RF filter of the present invention may adjust the cross coupling amount between corresponding resonators or the transmission zero by controlling the overlap area of the tuning sliding member 1300 disposed on the upper surface 1002*a* of the cover 1002 and the dielectric area 1302.

In above description, the tuning sliding member 1300 has rectangular shape, but may have variously shapes as long as it is overlapped on the dielectric area 1302 to change the capacitance between the tuning elements 1402*a* and 1402*b*.

The tuning sliding member 1300 is disposed on the position corresponding to the first tuning element 1014*a* in FIG. 14, but may be disposed on the position corresponding to the second tuning element 1014*b*.

The tuning elements 1014*a* and 1014*b* may move up and down through their rotation.

Figure 15:
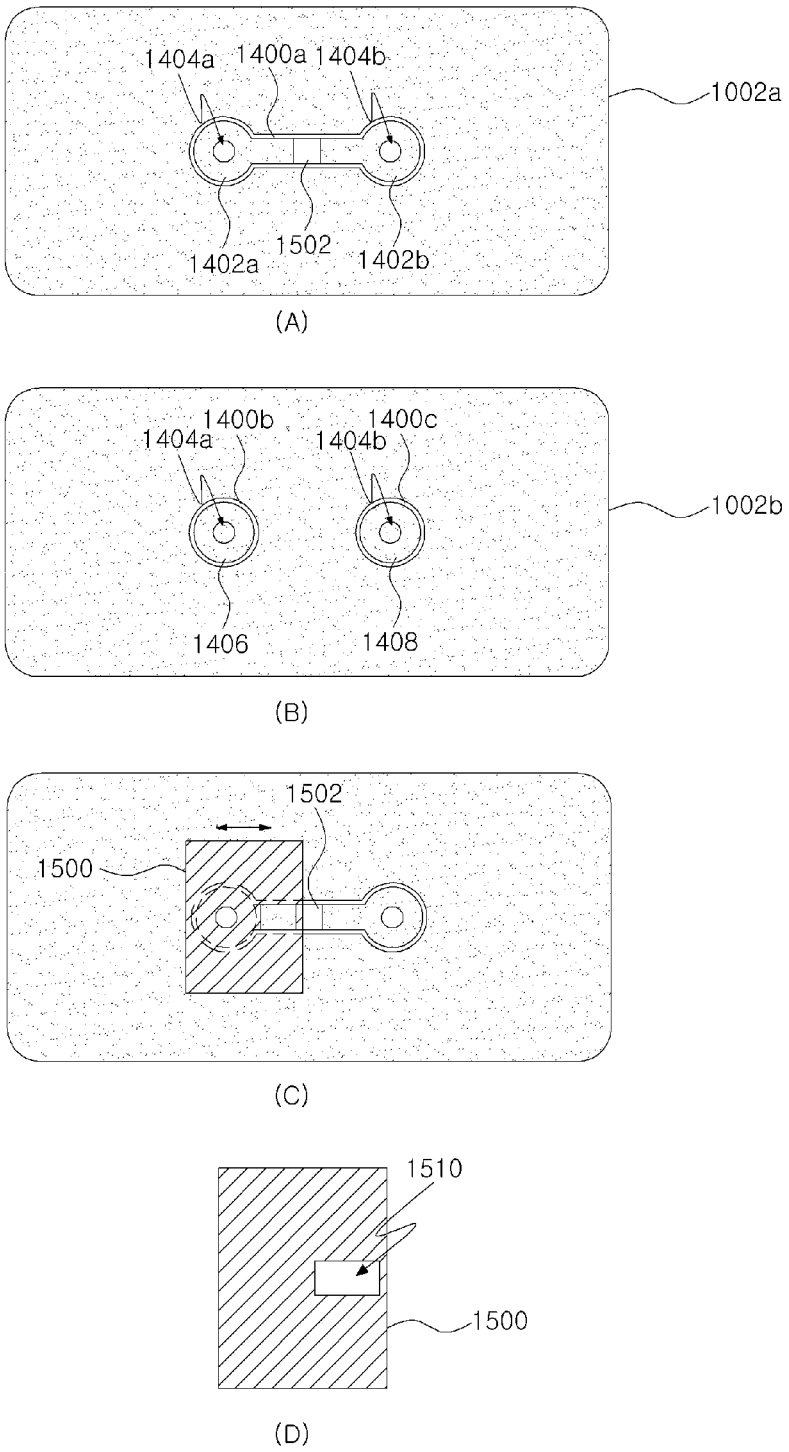
FIG. 15(A), FIG. 15(B), and FIG. 15(C) are views illustrating a cover of an RF filter according to a fifth embodiment of the present invention and FIG. 15 (D) is a view illustrating a tuning sliding member of the cover in FIG. 15 (C) according to one embodiment of the present invention.

FIG. 15 is a view illustrating a cover of an RF filter according to a fifth embodiment of the present invention.

In FIG. 15, a tuning sliding member 1500 is disposed on an upper surface 1002*a* of a cover 1002 in the RF filter of the present embodiment. Unlike the fourth embodiment where the tuning sliding member 1300 is supported by the first tuning element 1014*a*, the tuning sliding member 1500 is disposed on the first tuning element 1014*a* as shown in FIG. 15(C). The tuning sliding member 1500 overlaps on a dielectric area 1502, and so cross coupling amount between corresponding resonators or transmission zero is changed.

A hole 1510 may be formed on the tuning sliding member 1500 as shown in FIG. 15(D).

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An RF filter comprising:

a housing member;

cavities defined by walls in the housing member;

resonators located in the cavities;

a cover combined with an upper surface of the housing member;

a first tuning area formed on one surface of the cover;

a second tuning area formed on the one surface of the cover, wherein the second tuning area is separated from the first tuning area;

a dielectric area formed between the first tuning area and the second tuning area on the one surface of the cover;

a first tuning element inserted into a first cavity of the housing member through the first tuning area of the cover;

a second tuning element inserted into a second cavity of the housing member through the second tuning element of the cover; and a tuning sliding member disposed on the one surface of the cover, wherein a coupling window is formed between a part of the cavities, wherein transmission zero or cross coupling amount between the resonators located in a remainder of the cavities in which the coupling window is not formed are varied depending on an overlap area of the tuning sliding member and the dielectric area.

2. The RF filter of claim 1, wherein a first hole and a second hole are formed on a part of the tuning sliding member, the tuning sliding member slides while being supported by the first tuning element through the first hole.

3. The RF filter of claim 1, wherein the tuning sliding member slides while disposed on the first tuning element.

4. The RF filter of claim 1, wherein the cover is formed by coating conductive material on a dielectric member, the first tuning area and the second tuning area are formed by etching a part of the one surface of the cover, and the tuning sliding member is made up of dielectric material.

5. The RF filter of claim 1, wherein at least one of the first tuning element and the second tuning element moves up and down, each of the first tuning element and the second tuning element is a bolt, the first tuning element is fixed to the one surface of the cover by a first nut, and the second tuning element is fixed to the one surface of the cover by a second nut, the first tuning element and the second tuning element are disposed symmetrically with respect to specific wall of the walls.

* * * * *